US006378652B1

(12) United States Patent
Albert

(10) Patent No.: US 6,378,652 B1
(45) **Date of Patent: *Apr. 30, 2002**

(54) LATERAL JIB FOR VERTICAL MAST MOBILE ELEVATING WORK PLATFORM

(75) Inventor: Jean-Claude Albert, St. Medard en Jalles (FR)

(73) Assignee: Grove U.S.L.L.C., Shady Grove, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/237,800

(22) Filed: Jan. 27, 1999

(30) Foreign Application Priority Data

Jan. 27, 1998 (FR) ..... 98 00855

(51) Int. Cl.[7] ..... B66F 11/04
(52) U.S. Cl. ..... 182/69.4; 182/148
(58) Field of Search ..... 182/2.9, 2.7, 2.11, 182/69.4, 148

(56) References Cited

U.S. PATENT DOCUMENTS

| | | | | |
|---|---|---|---|---|
| 3,202,242 A | * | 8/1965 | Dolphin | |
| 3,933,224 A | * | 1/1976 | Nilsson | |
| 4,484,663 A | | 11/1984 | Wyse | |
| 4,511,015 A | | 4/1985 | Purdy | |
| 4,724,924 A | | 2/1988 | Breyer et al. | |
| 4,757,875 A | | 7/1988 | Hade, Jr. et al. | |
| 4,949,816 A | * | 8/1990 | Brown | |
| 4,967,876 A | | 11/1990 | Richardson et al. | |
| 5,203,425 A | | 4/1993 | Wehmeyer | |
| 5,271,707 A | | 12/1993 | Derksen et al. | |
| 5,307,898 A | * | 5/1994 | Purdy | 182/69.4 |
| 5,337,858 A | | 8/1994 | Neubauer et al. | |
| 5,634,529 A | | 6/1997 | Nguyen et al. | |

FOREIGN PATENT DOCUMENTS

| | | |
|---|---|---|
| DE | 8534229 V | 12/1987 |
| DE | 9104078.7 | 7/1991 |
| EP | 0106506 | 4/1984 |
| EP | 0286301 | 10/1988 |
| EP | 0341918 | 11/1989 |
| EP | 0590409 A1 | 4/1994 |
| EP | 0692449 A1 | 1/1996 |
| FR | 2179139 | 11/1973 |
| FR | 2201692 | 4/1974 |
| FR | 8219170 | 10/1983 |
| FR | 2628090 | 9/1989 |
| WO | WO 9405587 | 3/1994 |

OTHER PUBLICATIONS

Grove Advertisement (1 Page).

* cited by examiner

*Primary Examiner*—Alvin Chin-Shue

(57) ABSTRACT

A lifting apparatus for a mobile crane work platform comprising a telescopic mast with a base section, and a plurality of vertically movable sections, the work platform being connected by an articulated arm assembly to the highest deployed movable section of the mast, the telescopic mast being collapsible to a lowered position and extensible to a deployed position. The articulated arm is connected to the highest movable section laterally of the axis of the mast so that the arm is outside of a space between the mast and the work platform when in the lowered position to thereby minimize the horizontal length of the lifting apparatus.

26 Claims, 4 Drawing Sheets

LATERAL JIB FOR VERTICAL MAST MOBILE ELEVATING WORK PLATFORM

BACKGROUND OF THE INVENTION

The present invention relates to improved lifting gear comprising a stationary or mobile chassis, a variable height mast comprising a base section connected to said chassis and at least one movable section that can move with respect to said base section between a lowered position in which said at least one movable section is collapsed, and a raised position in which said at least one movable section is deployed upward, a lifting platform connected to said mast via the movable section that is intended to be the highest deployed section, by means of at least one articulated arm.

This type of lifting gear is widely used in trade and industry for working heights and, more particularly, for working over obstacles, especially in warehouses in order to access the top shelves; or in workshops and other areas of industrial; or commercial activity. The mast can be deployed upward in order to raise the platform or gondola containing at least one operator or a load, and the articulated arm allows the platform or gondola to be moved away from the mast to give the operator or the load access over an obstacle.

Lifting gear of this existing type works perfectly well, but in some cases is too bulky in the lengthwise direction when in the lowered position. This drawback restricts or complicates the use of such gear which in particular cannot get into lifts or goods lifts, or cannot be maneuvered down narrow trafficways or in cluttered areas that are encountered in workshops, warehouses, commercial areas, or the like.

SUMMARY OF THE INVENTION

The present invention sets out to overcome this drawback.

One object of the present invention is, therefore, to offer lifting gear of reduced length which at the same time allows an excellent radius of action for the lifting platform.

Another object of the present invention is also to offer a device with a lower total weight.

Another object of the present invention is to offer a device of lower total cost and excellent reliability.

More specifically, the invention consists in improved lifting gear comprising:

- a stationary or mobile chassis,
- a variable-height mast comprising a base section connected to said chassis and at least one movable section that can move with respect to said base section between a lowered position in which said at least one movable section is collapsed, and a raised position in which said at least one movable section is deployed upward,
- a lifting platform connected to said mast via the movable section that is intended to be the highest deployed section, by means of at least one articulated arm,
- characterized in that said at least one articulated arm is connected to said movable section intended to be the highest deployed section and positioned with respect to the latter laterally so that said at least one articulated arm is outside of a space between said lifting platform and said mast in the lowered position.

The lateral connection and the lateral position of the articulated arm makes it possible to free up all of the space between the lifting platform and the mast so that the platform can abut the mast or be very close to the latter in the lowered position, leading to the greatest possible reduction in the collapsed length of the lifting gear.

The prior art teaches the use of an articulated arm placed between the gondola or the lifting platform and the mast. A design of this kind, guided by an idea of symmetry, of obviousness, and of balancing of forces, does, however, increase the length of the lifting gear or of the lifting platform by the thickness of the arm and sometimes of the ram that actuates this arm; any solution using this design which allows the bulk of these elements to be reduced not, however, allowing their thickness to be canceled out completely.

According to an advantageous feature of the present invention, said lifting platform is connected to said at least one articulated arm laterally in such a way that it can be placed, in said lowered position, symmetrically with respect to the longitudinal axis of said lifting gear.

According to an additional advantageous feature, the lifting gear according to the invention comprises at least one ram for actuating said at least one articulated arm, and said at least one ram is arranged between said mast and said articulated arm.

According to another advantageous feature, said articulated arm comprises a parallelogram structure and said ram acts more or less along a diagonal of said parallelogram.

According to another advantageous feature, said mast comprises at least two successive sections, which are juxtaposed and joined together so that they can slide by means of slideways.

According to an advantageous feature which is in addition to the previous feature, said sections are joined together in such a way that said lifting platform is connected to the section which is furthest away from it when said mast is in the lowered position.

According to an alternative feature, said mast comprises at least two successive sections with tubular profiles, nesting one inside the other in sliding fashion.

Other features and advantages will become clear from reading the description which follows of several embodiments of lifting gear according to the invention, accompanied by the appended drawings, the embodiments being given by way of illustration and without implying any restriction on the way in which the invention can be interpreted.

BRIEF DESCRIPTION OF DRAWINGS

The present invention will become more fully understood from the detailed description given hereinbelow and the accompanying drawings which are given by way of illustration only, and thus are not limitative of the present invention, and wherein.

Figure 1:
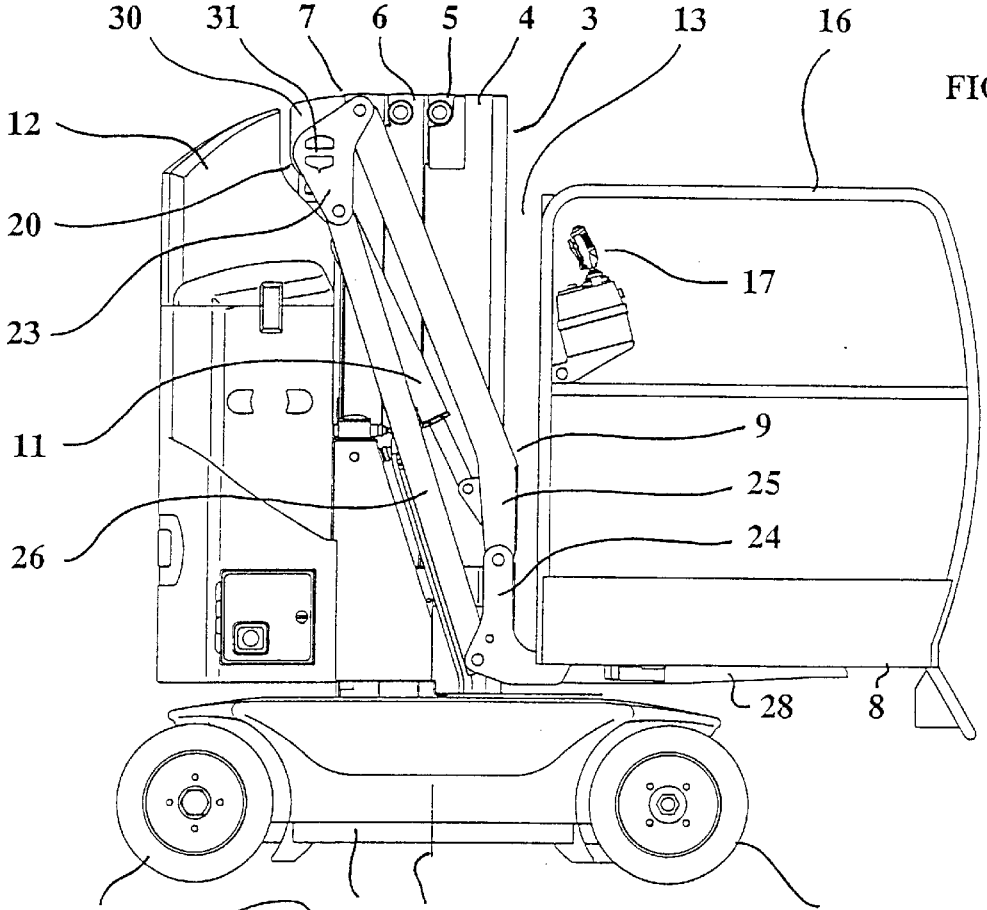
FIG. 1 depicts a side view of a first embodiment of lifting gear according to the invention, in the lowered position.
Figure 2:
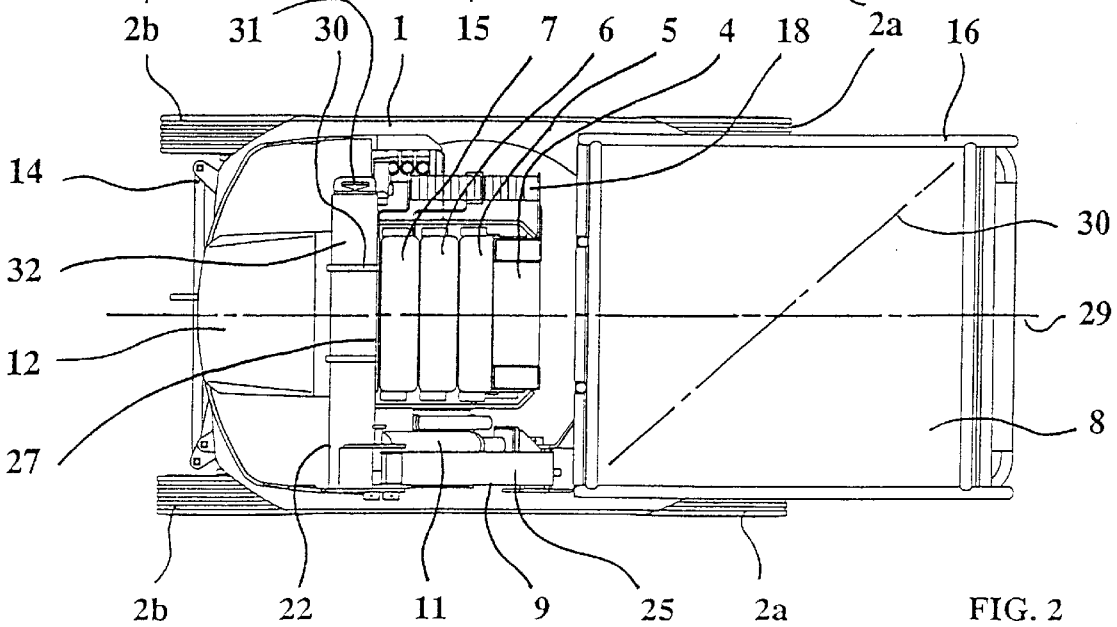
FIG. 2 depicts a view from above of the embodiment of FIG. 1, in the same position.
Figure 3:
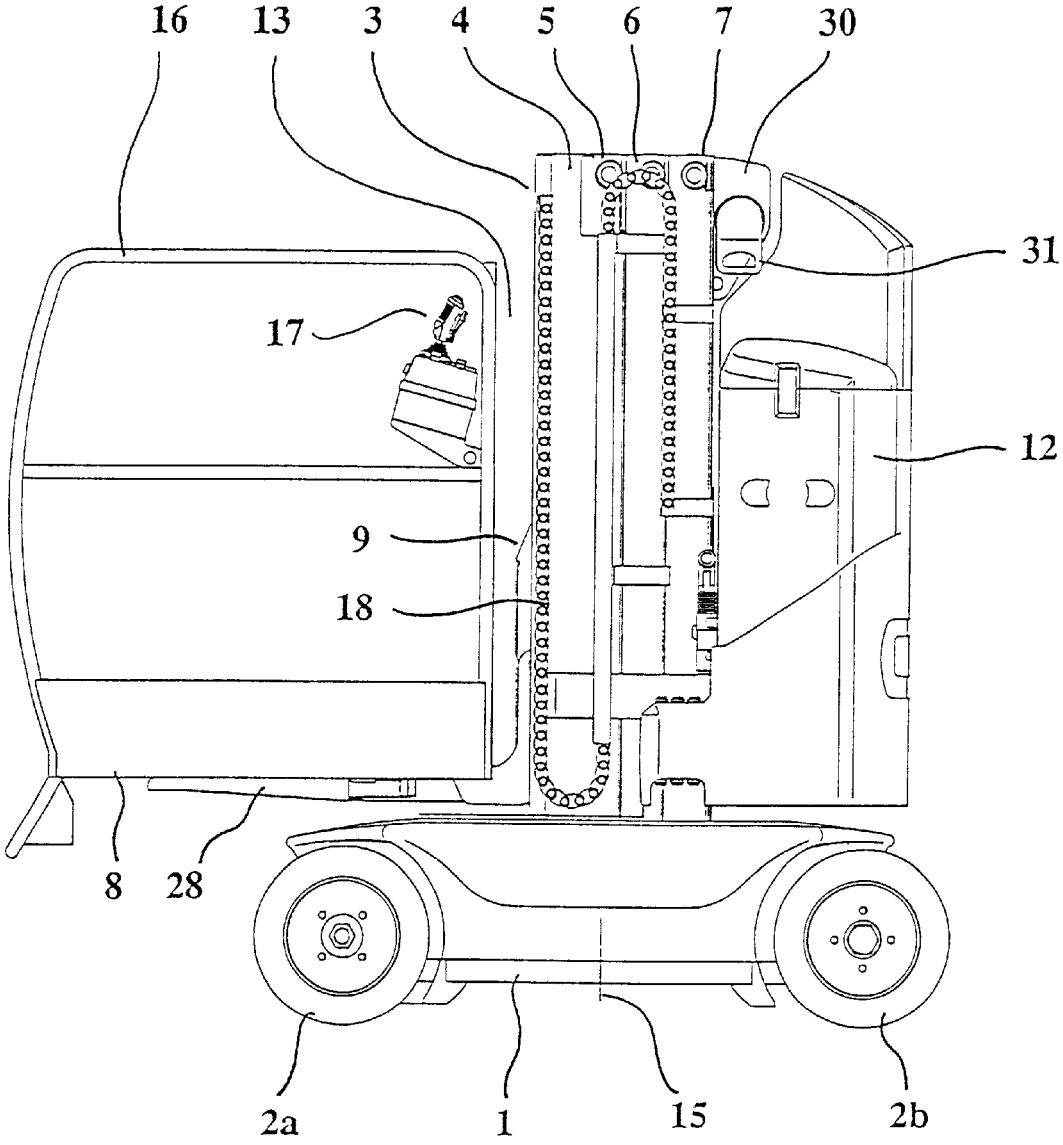
FIG. 3 depicts a view of the embodiment of FIG. 1 in the same position, from the opposite side to the one depicted in FIG. 1.
Figure 4:
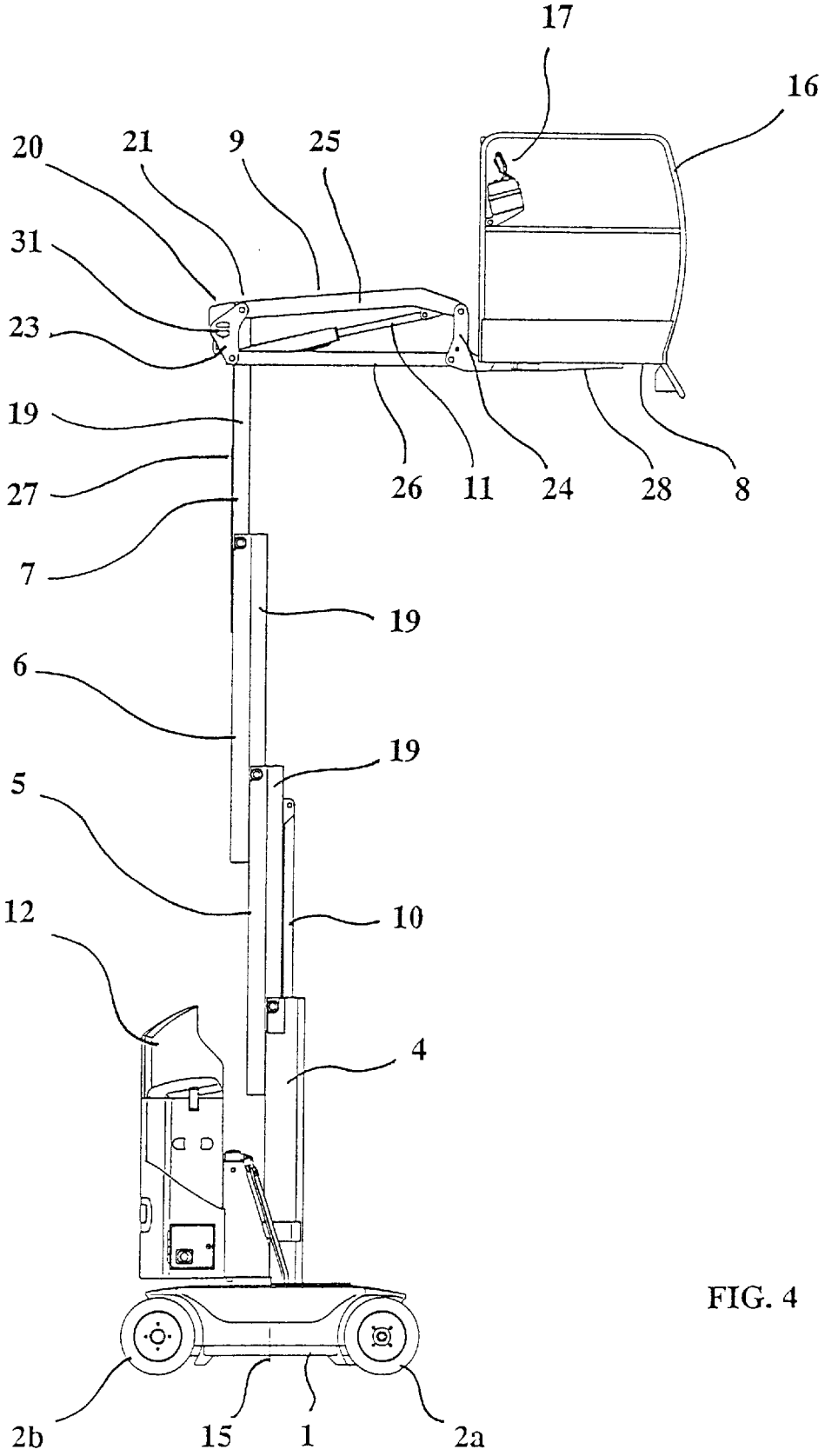
FIG. 4 depicts a view of the embodiment of FIG. 1, on a smaller scale, in the raised position and in a first working position.
Figure 5:
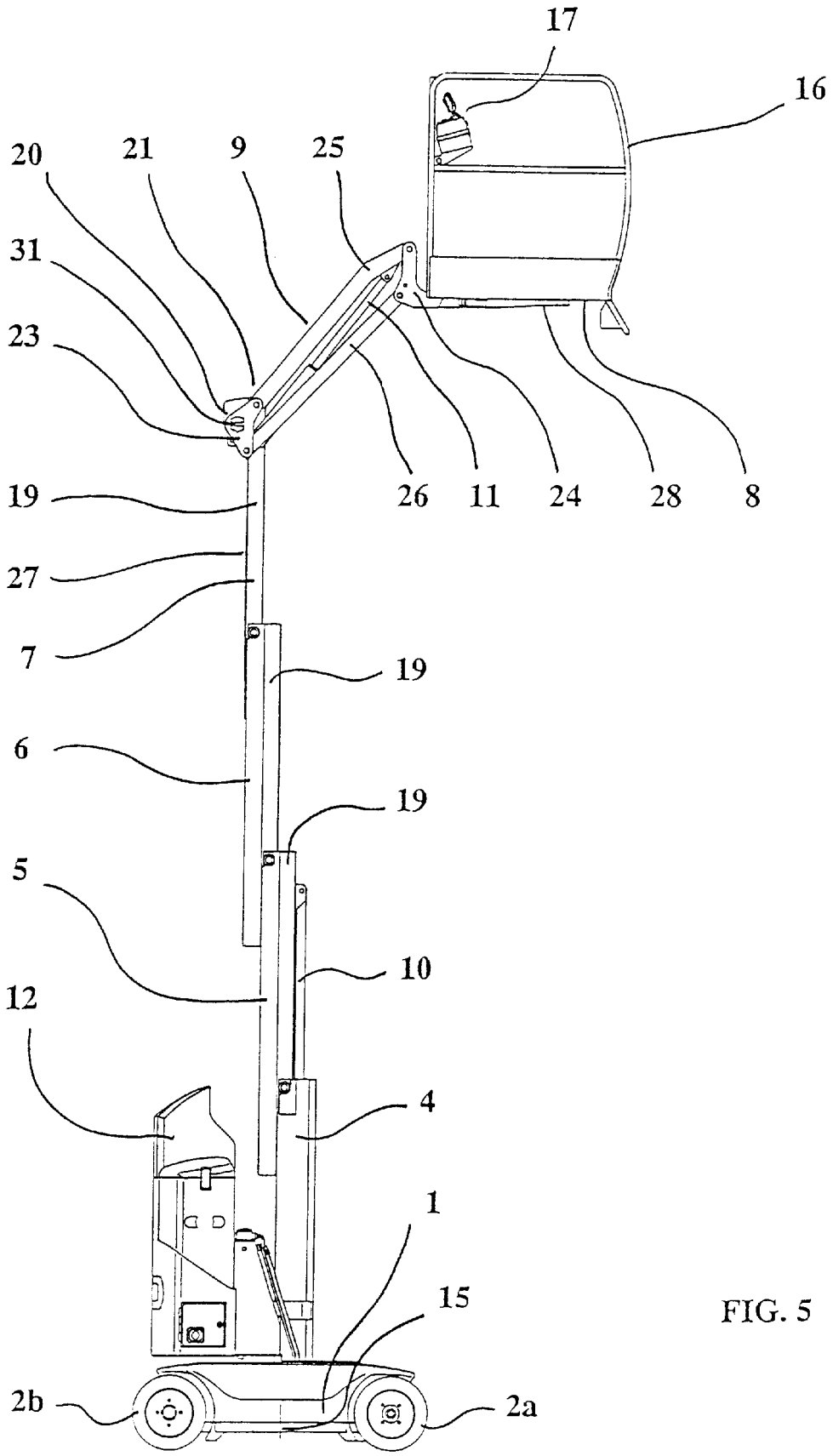
FIG. 5 depicts a view similar to FIG. 4, but in a second working position.

The lifting gear depicted in FIGS. 1 to 5, comprises, in the known way, a chassis 1 which is advantageously mobile by means of four wheels 2*a*, 2*b*, a variable-height mast 3, preferably vertical, comprising a base section 4 connected to the chassis 1, and three sections 5, 6 and 7 which can move with respect to the base section 4 between a lowered position, depicted in FIGS. 1 to 3, in which the three movable sections 5, 6 and 7 are collapsed, and a raised position, depicted in FIGS. 4 and 5, in which the three movable sections 5, 6 and 7 are deployed upward, a lifting platform 8 connected to the mast 3 by the movable section 7 intended to be the highest of the deployed sections movable, by means of an articulated arm 9, the latter according to the invention being connected to the movable section 7 and positioned laterally with respect to the latter so that the articulated arm 9 is outside of the space 13 between the platform 8 and the mast 3 in the lowered position.

The lifting gear depicted in FIGS. 1 to 5 is advantageously self-propelled by means of two driven wheels 2*a* and two guiding wheels 2*b*, and for example an electric motor (not depicted) powered by rechargeable accumulator batteries (not depicted). As a preference, the electric motor drives a hydraulic pump (not depicted) which supplies hydraulic energy to all the receiver elements needed for the operation of the lifting gear, in particular hydraulic motor(s) for driving the driven wheels (these motors are not depicted), hydraulic motor(s) (not depicted) for rotating the mast 3, as explained below, ram 10 for raising and lowering the mast 3, ram 11 for actuating the articulated arm 9, ram(s) (not depicted) for operating the steering 14 of the lifting device, all this in the known way. The self-propelled lifting gear may be fitted with any appropriate means of braking and immobilizing it on the ground (these means are not depicted).

In the known way, the base section 4 of the mast 3 is advantageously connected to the chassis 1 via a pivot so as to allow the mast 3 and the lifting platform 8 connected to the latter to turn about a vertical axis 15, the chassis 1 remaining immobile on the ground. The vertical axis 15 corresponds to the axis of rotation of the pivot and preferably will be aligned with the longitudinal axis 29 of the lifting gear. The mast 3 will preferably be more or less centered on the pivot.

The lifting gear depicted in FIGS. 1 to 5 comprises a counterweight 12 secured to the mast 3, calculated and placed in such a way that it allows the loadings caused by the platform 8 and by the operatorts) or load(s) it contains to be balanced, and for this to be achieved in all the envisaged positions of the platform 8 and of the chassis 1. The rechargeable accumulator batteries will advantageously be used as a counterweight, and will, therefore, be housed in the place intended for this.

The lifting platform 8 is designed to accommodate at least one operator, and is therefore fitted with a guard rail 16. The controls for operating the actuators of the lifting gear depicted in FIGS. 1 to 5 are housed together on a control panel 17 placed on the lifting platform so that an operator can maneuver the lifting gear from the platform irrespective of its position, as depicted, for example, in FIG. 4. Note that the control panel 17 has not been depicted in FIG. 2. An "actuator" is intended to mean any means that allows the state of the lifting gear to be altered, in particular hydraulic motors, electric motors, rams, etc. Thus, the elevator comprises an appropriate cable/pipe connection 18 connecting the panel 17 to the actuators. In order to prevent the linkage 18 from comprising an excessive number of hydraulic pipes leading, on account of the variable-height mast 3, to additional weight and complexity, the hydraulic distributor members will preferably be placed at the base of the mast 3. With the exception of the supply to the ram 11 for actuating the articulated arm 9, the linkage 18 will, therefore, preferably be an electrical linkage.

The four sections 4, 5, 6 and 7 of the mast 3 are advantageously juxtaposed and joined together in sliding fashion by means of slideways 19 as depicted in FIGS. 4 and 5. In addition, the sections 4, 5, 6 and 7 are advantageously joined together in such a way that the lifting platform 8 is connected to the section 7, which is furthest away from it when the mast 3 is in the lowered position as depicted in FIGS. 1 to 3. A configuration of this kind allows the mast to play a part in balancing out the loadings, and therefore allows a corresponding reduction in the mass of the counterweight 12 needed. What happens, as can be seen in FIGS. 4 and 5, is that the weight of the vertically movable sections 5, 6 and 7 partially compensates for the weight of the platform 8 and of the arm with respect to the base section 4, particularly in the case of sloping ground (not depicted).

The first movable section 5 starting from the base of the mast 3 moves vertically over the base section 4 advantageously by means of the hydraulic ram 10 as depicted in FIGS. 4 and 5, and the other movable sections 6 and 7 move vertically, advantageously thanks to a chain and pulley-block system (not depicted) moved by the first movable section 5, in the known way. The movable section 7 intended to be highest, comprises an arm support 20 fixed rigidly in the region of the top 21 of the section 7, the support 20 being designed to allow the articulated arm to be attached. The arm support 20 will preferably be fixed to the rear face 27 of the section 7 furthest from the platform 8 so as to reduce the height of the device when the mast 3 is collapsed, and so as to allow the arm a longer length for a given mast height. The arm support 20 has a part 22 which projects laterally from the section 7, as depicted in FIG. 2, allowing the articulated arm 9 to move in the space beside the mast 3. The support 20 will preferably comprise a tube 32 of circular section welded to the section 7 by two mounting plates 30, as depicted in FIGS. 1 to 3. Means needed for an articulated connection of the arm 9 will be welded to the protruding part 22 of the support 20, for example in the form of an articulation clevis mount 23, as explained below. Furthermore, an attachment lug 31 will advantageously be welded to each end of the tube 32 in order to allow the lifting gear to be strapped down onto a transport vehicle, using lashing straps, for example.

The articulated arm 9 advantageously comprises a parallelogram structure 23, 24, 25, 26. The support 20, together with the articulation clevis mount 23 forms a first side of the four sides of the parallelogram defined by the articulated arm 9, the first side 23 thus formed being stationary with respect to the movable mast section 7. A second side 24 of the parallelogram, opposite the first side 23, is secured to a support 28 for attaching the lifting platform 8 and is therefore stationary with respect to the latter. The third and fourth sides 25, 26 of the parallelogram are connected to the first side 23 and to the second side 24 by means of articulations, as depicted in FIGS. 4 and 5, in such a way as to form the parallelogram and make it possible to make the platform 8 move by horizontal translation thereof relative to the section 7.

As a preference, the kinematics of the articulated arm 9 will be determined in such a way that the lifting platform 8, when the mast 3 and the articulated arm 9 are in the lowered position, is placed as close as possible to the mast, that is to say, in the example depicted, as close as possible to the vertically stationary base section 4 of the mast, and also as close as possible to the wheels placed directly underneath, as depicted in FIG. 1 or 3, and in such a way that the lifting platform 8 can be moved above the highest point of the mast section 7 intended to be the highest movable section, as depicted in FIG. 5. The articulated arm 9 will advantageously move in a vertical plane parallel to the vertical axis 15 of rotation of the mast 3.

FIG. 4 depicts the lifting gear with the articulated arm 9 more or less horizontal, giving the lifting platform 8 the maximum radius of action, obtained in all Fit., directions of a horizontal plane by rotating the mast about the axis 15. FIG. 5 depicts the lifting gear with the articulated arm 9 in the fully raised position, giving the lifting platform 8 its maximum working height.

As was explained earlier, the first side of the parallelogram advantageously adopts the form of an articulation clevis mount 23, the second side of the parallelogram also advantageously adopts the form of an articulation clevis mount 24, and the third and fourth sides 25 and 26 of the parallelogram are formed of metal section pieces, the respective ends of which are articulated in the clevis mounts 23 and 24. The four sides of the parallelogram will be capable of withstanding the torsional loading caused by the lateral attachment of the lifting platform 8 and by a lateral ram 11; if necessary and for this purpose one of the two sides 25 or 26, or both, will advantageously be chosen to be made of a tubular section piece, for example a section piece of square or rectangular section.

The ram 11 for actuating the articulated arm 9 will advantageously be arranged between the mast 3 and the articulated arm 9, for example offset slightly with respect to the arm in the direction of the mast 3, as depicted in FIG. 2, so as to take account of the torsional loading caused by a lateral attachment of the platform 8 and of the ram. In addition, the ram 11 will preferably be arranged more or less along a diagonal of the parallelogram in order in particular to be protected naturally from impacts by the articulated arm itself. For this purpose, the ram 11 is articulated, in the example depicted, at one of its ends so that it is coaxial with the articulation of the sides 23 and 26 of the parallelogram, and at its other end, to the side 25 of the parallelogram in a region close to the articulation between the sides 24 and 25. The end-of-travel stops of the ram 11 may advantageously be used as stops that restrict the movement of the articulated arm 9.

The lifting platform 8 will advantageously be connected to the articulated arm 9 laterally so that it can be placed symmetrically with respect to the longitudinal axis 29 of the lifting gear when the mast 3 and the arm 9 are in the lowered position, as depicted in FIG. 2. For this, the support 28 for attaching the platform 8 will support the latter or will be attached to it by one of its corners, as depicted in FIG. 2 with a lifting platform 8 of rectangular shape. Insofar as the platform 8 requires a support structure to make it rigid, the support 28 may comprise a support beam more or less following a diagonal 30 of the platform 8. As a preference, the lifting platform 8 will fall within the maximum width of the lifting gear as defined in the example depicted by the four wheels 2*a*, 2*b*, this being when the platform 8 is in the lowered position (mast 3 and arms 9 collapsed) the mast 3 being rotated in its position for minimum widthwise bulk for the purposes of moving the lifting gear along the ground, this position being depicted in FIGS. 1 to 3.

It is possible to envisage an alternative way from the example depicted of connecting the platform to the articulated arm 9, along a plane or axis of symmetry of the platform; this configuration would require the mast 3 and its articulated arm 9 to be rotated about the vertical axis of rotation axis 15 with an overhang, or for the mast 3 to be laterally offset so that in the lowered position for moving the lifting gear along the ground (mast 3 and arms 9 collapsed); the projection of the articulated arm onto a horizontal plane would be aligned with a plane or axis of symmetry of the platform.

Note that numerous alternative forms (not depicted) relating to the articulated arm for attaching the platform may be produced, in terms of the shape, position, and number of arms. Note, for example, that the lifting gear may also comprise a second lateral articulated arm, placed symmetrically with respect to the mast 3 along the longitudinal axis 29 of the lifting gear and held on the support 20 then projecting laterally from each side of the mast; in this configuration, one or two arm-actuating rams can be used, as described above. When two symmetric rams are used, the torsion generated by one lateral arm and one lateral ram is avoided, but the device becomes more expensive. In the embodiment of articulated arm depicted in FIGS. 1 to 5, it is also possible to envisage the alternative of a ram 11 (protected from impacts) placed more or less symmetrically to the articulated arm 9 with respect to the longitudinal axis 29 of the lifting gear. Note too that a single articulated arm may be placed on one side or the other of the mast 3 with respect to the longitudinal axis of the lifting gear. The articulating arm may alternatively consist of a single bar articulated at one of its ends to the support 20 and the other end to the platform or its support 28, in place of the parallelogram structure; if this is the case, the platform 8 is kept in a horizontal position as the -articulated arm moves by using appropriate slaving.

As an alternative to the embodiment depicted in FIGS. 1 to 5, the variable-height mast may comprise at least two successive sections with tubular profile, nesting one inside the other in sliding fashion (not depicted) A mast of this kind may, for example, adopt a square or rectangular transverse section, for each of its sections. The last section which is intended to be the highest and connected to the articulated arm may extend upward beyond the other sections when the mast is collapsed in order to allow the articulated arm to be connected laterally as explained earlier for example.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An improved lifting apparatus including a chassis, a variable-height vertically extending mast having a base section non-tiltably fixed to said chassis and at least one movable section nestingly mating with and movably connected to said base section such that said at least one movable section can move with respect to said base section between a lowered position in which said at least one movable section is collapsed and a raised position in which said at least one movable section is deployed upward, and a lifting platform connected to said mast via a top section of said at least one movable section that is intended to be the highest deployed section, wherein said mast sections are joined together in an arrangement wherein the center of gravity of said base section is closer laterally to the platform than the center of gravity of said at least one movable section, wherein said lifting platform is connected to said mast by a support including at least one articulated arm connected to said movable mast section intended to be the highest deployed section, and a lifting device for moving said lifting platform and said at least one articulated arm with respect to said mast.

2. An improved lifting apparatus as in claim 1, wherein said support consists essentially of said at least one articulated arm and said lifting device, and wherein all elements of said support are positioned outside of a space between said lifting platform and said mast.

3. An improved lifting apparatus as in claim 2, wherein said chassis is mobile.

4. A lifting apparatus comprising:

a chassis;

a counterweight connected to said chassis;

a vertically extending variable-height mast including a base section non-filtably fixed to said chassis, said mast including a first section, a second section nestingly mating with and movably connected to said first section, and a top section movably connected to said second section, said top section having a first side facing toward said counterweight and a second side facing opposite to said first side; and a lifting platform located on said second side of said top section and connected to said top section, wherein said first section has a first center of gravity; said second section has a second center of gravity; said top section has a third center of gravity; said first center of gravity is located above a first point on said chassis when said chassis is horizontal; said second center of gravity is located above a second point on said chassis when said chassis is horizontal; said third center of gravity is located above a third point on said chassis when said chassis is horizontal; said second point is closer to said counterweight than said first point; and said third point is closer to said counterweight than said second point, wherein said lifting platform is connected to said top section by at least one articulated arm; and further including, a lifting device for moving said lifting platform and articulated arm with respect to said top section.

5. The lifting apparatus according to claim 4, wherein said lifting platform is connected to a portion of said top section remote from said second side of said top section.

6. The lifting apparatus according to claim 5, wherein said portion of said top section, to which said lifting platform is connected, is located on said first side of said top section facing said counterweight.

7. The lifting apparatus according to claim 4, further comprising: a first slideway movably connecting said first section to said second section; and a second slideway movably connecting said second section to said top section.

8. The lifting apparatus according to claim 4, wherein said chassis is mobile.

9. The lifting apparatus according to claim 4, wherein said top section and said second section are nestingly mated, one to the other.

10. A lifting apparatus comprising:

a chassis;

a vertically extending variable-height mast including a base section non-tiltably fixed to said chassis, said mast including a first section, a second section nestingly mating with and movably connected to said first section, and a top section movably connected to said second section, said top section having a first side and a second side facing opposite to said first side; and a lifting platform located on said second side of said top section and connected to said top section, wherein said first section has a first center of gravity; said second section has a second center of gravity; said top section has a third center of gravity; said first center of gravity is located above a first point on said chassis when said chassis is horizontal; said second center of gravity is located above a second point on said chassis when said chassis is horizontal; said third center of gravity is located above a third point on said chassis when said chassis is horizontal; said second point is further from said lifting platform than said first point; and said third point is further from said lifting platform than said second point, wherein said lifting platform is connected to said top section by at least one articulated arm; and further including, a lifting device for moving said lifting platform and articulated arm with respect to said top section.

11. The lifting apparatus according to claim 10, wherein said lifting platform is connected to a portion of said top section remote from said second side of said top section.

12. The lifting apparatus according to claim 11, wherein said portion of said top section, to which said lifting platform is connected, is located on said first side of said top section.

13. A lifting apparatus comprising:

a chassis;

a counterweight connected to said chassis;

a vertically extending variable-height mast including a base section non-tiltably fixed to said chassis, said variable-height mast including two adjacently connected sections which are nestingly mated one to the other and which can move, one relative to the other, wherein a lower section of said two adjacent sections has a first center of gravity; an upper section of said two adjacent sections has a second center of gravity, said first center of gravity is located above a first point on said chassis when said chassis is horizontal; said second center of gravity is located above a second point on said chassis when said chassis is horizontal; and said second point is closer to said counterweight than said first point; and a lifting platform attached to said top section, wherein said lifting platform is connected to said top section by at least one articulated arm; and further including, a lifting device for moving said lifting platform and articulated arm with respect to said top section.

14. The lifting apparatus according to claim 13, wherein said lower section is said base section.

15. The lifting apparatus according to claim 13, further comprising:

a top section of said variable-height mast adjacently connected to said upper section which can move relative to said upper section.

16. The lifting apparatus according to claim 15, wherein said top section and said upper section are nestingly mated, one to the other.

17. The lifting apparatus according to claim 13, wherein said top section has a first side facing toward said counterweight and a second side facing opposite to said first side, and wherein said lifting platform is located on said a second side of said top section and connected to a portion of said top section remote from said second side.

18. The lifting apparatus according to claim 17, wherein said portion of said top section, to which said lifting platform is connected, is located on said first side of said top section facing said counterweight.

19. The lifting apparatus according to claim 13, further comprising:

a slideway movably connecting said upper section to said lower section.

20. The lifting apparatus according to claim 15, further comprising:

a first slideway movably connecting said upper section to said lower section; and a second slideway movably connecting said upper section to said top section.

21. The lifting apparatus according to claim 13, wherein said chassis is mobile.

22. A lifting apparatus comprising:

a chassis;

a vertically extending variable-height mast including a base section non-tiltably fixed to said chassis, said variable-height mast including two adjacently connected sections which are nestingly mated one to the other and which can move, one relative to the other, wherein a lower section of said two adjacent sections has a first center of gravity and an upper section of said two adjacent sections has a second center of gravity; and a lifting platform connected to said upper section, wherein said first center of gravity is located above a first point on said chassis when said chassis is horizontal; said second center of gravity is located above a second point on said chassis when said chassis is horizontal; and said second point is further from said lifting platform than said first point, wherein said lifting platform is connected to said upper section by at least one articulated arm; and further including, a lifting device for moving said lifting platform and articulated arm with respect to said upper section.

23. The lifting apparatus according to claim 22, wherein said upper section has a first side and a second side facing opposite to said first side, and wherein said lifting platform is located on said a second side of said upper section and connected to a portion of said upper section remote from said second side.

24. The lifting apparatus according to claim 23, wherein said portion of said upper section, to which said lifting platform is connected, is located on said first side of said upper section.

25. The lifting apparatus according to claim 22, further comprising:

a slideway movably connecting said upper section to said lower section.

26. The lifting apparatus according to claim 22, wherein said chassis is mobile.

* * * * *